US011052275B1

(12) United States Patent
Garick

(10) Patent No.: US 11,052,275 B1
(45) Date of Patent: Jul. 6, 2021

(54) ELASTIC BAND RESISTANCE DEVICE AND METHOD FOR PHYSICAL THERAPY AND REHABILITATION

(71) Applicant: OFF THE BENCH INNOVATIONS, LLC, Miami, FL (US)

(72) Inventor: Hayley Garick, Miami, FL (US)

(73) Assignee: OFF THE BENCH INNOVATIONS, LLC, Miami, FL (US)

( * ) Notice: Subject to any disclaimer, the term of this patent is extended or adjusted under 35 U.S.C. 154(b) by 0 days.

(21) Appl. No.: 16/253,322

(22) Filed: Jan. 22, 2019

(51) Int. Cl.

| | |
|---|---|
| ***A63B 21/04*** | (2006.01) |
| ***A63B 21/00*** | (2006.01) |
| ***A63B 71/00*** | (2006.01) |
| ***A63B 21/055*** | (2006.01) |
| ***A63B 23/08*** | (2006.01) |
| ***A63B 23/10*** | (2006.01) |

(52) U.S. Cl.
CPC .... *A63B 21/0442* (2013.01); *A63B 21/00061* (2013.01); *A63B 21/00065* (2013.01); *A63B 21/00069* (2013.01); *A63B 21/0557* (2013.01); *A63B 21/4034* (2015.10); *A63B 21/4039* (2015.10); *A63B 23/08* (2013.01); *A63B 23/10* (2013.01); *A63B 71/0036* (2013.01); *A63B 2209/00* (2013.01); *A63B 2225/093* (2013.01)

(58) Field of Classification Search
CPC ..... A63B 21/4034; A63B 21/00065; A63B 21/4039; A63B 21/00061; A63B 21/0442; A63B 23/08; A63B 23/10; A63B 21/00069; A63B 21/0557; A63B 21/002; A63B 21/020557; A63B 21/0023; A63B 21/4013; A63B 21/0555; A63B 2209/00; A63B 2225/093; A63B 23/0458; A63B 23/0464; A63B 71/0036
USPC ..... 482/79
See application file for complete search history.

(56) References Cited

U.S. PATENT DOCUMENTS

| | | | | |
|---|---|---|---|---|
| 3,593,995 | A * | 7/1971 | Eckstrom | A63B 19/00 482/110 |
| 6,730,005 | B1 * | 5/2004 | Liao | A47C 3/16 446/220 |
| 6,740,008 | B1 * | 5/2004 | Ho | A63B 21/0004 482/123 |
| 7,322,914 | B1 * | 1/2008 | Vittone | A63B 21/055 482/146 |
| 9,364,700 | B2 * | 6/2016 | Yan | A63B 21/023 |
| 9,415,276 | B1 * | 8/2016 | Hao | A63B 21/02 |
| 9,943,725 | B2 * | 4/2018 | Todd | A63B 23/03566 |
| 10,179,258 | B1 * | 1/2019 | Sabbagh | A63B 21/4015 |
| 10,232,213 | B1 * | 3/2019 | Smith, Jr. | A63B 23/1281 |

(Continued)

*Primary Examiner* — Gary D Urbiel Goldner
*Assistant Examiner* — Thao N Do
(74) *Attorney, Agent, or Firm* — Lott & Fischer, PL

(57) ABSTRACT

A physical therapy and rehabilitation device and method are provided having an anchoring member and vertical support members. The anchoring member may be comprised of a peripheral frame defining an open space. The peripheral frame is further comprised of mount points. A user is to situate their foot directly below the anchoring member. The heel of the user is placed centrally below the peripheral frame with the top of the foot extending into the open space. Elastic bands are attached to various mount point and the user's foot to create multiple directions of resistance upon the foot. The foot is then manipulated by the user to improve strength, flexibility, range of motion and proprioception.

14 Claims, 14 Drawing Sheets

(56) References Cited

U.S. PATENT DOCUMENTS

| | | | | |
|---|---|---|---|---|
| 2007/0249971 | A1* | 10/2007 | Doran | A63B 23/10 601/27 |
| 2008/0076638 | A1* | 3/2008 | Publicover | A63B 5/11 482/27 |
| 2011/0124476 | A1* | 5/2011 | Holley | A63B 23/02 482/121 |
| 2013/0005537 | A1* | 1/2013 | Chen | A63B 71/0054 482/27 |
| 2015/0209608 | A1* | 7/2015 | Hernandez | A63B 21/4034 482/123 |
| 2015/0231436 | A1* | 8/2015 | Januszek | A63B 6/00 482/142 |
| 2015/0314159 | A1* | 11/2015 | Buckman | A63B 21/4043 482/129 |
| 2016/0016026 | A1* | 1/2016 | Salas Peralta | A63B 21/0083 482/5 |
| 2016/0035228 | A1* | 2/2016 | Cakmak | A63F 13/42 434/247 |
| 2017/0001054 | A1* | 1/2017 | Liu | A63B 5/11 |
| 2017/0021226 | A1* | 1/2017 | Adams | A63B 23/03508 |
| 2017/0128762 | A1* | 5/2017 | De Palo | G10D 13/00 |
| 2017/0182343 | A1* | 6/2017 | Ho | A63B 21/00047 |
| 2018/0280757 | A1* | 10/2018 | Callanan | A63B 22/14 |
| 2019/0009121 | A1* | 1/2019 | Briggs | A63B 21/4027 |
| 2019/0299048 | A1* | 10/2019 | Pensivy | A63B 21/0442 |

* cited by examiner

ELASTIC BAND RESISTANCE DEVICE AND METHOD FOR PHYSICAL THERAPY AND REHABILITATION

TECHNICAL FIELD

The present invention relates generally to physical therapy and rehabilitation and in particular to a device and method for the treatment and strengthening of the lower extremities using resistance bands, a plyometric box, a removable uneven surface and stretch straps.

BACKGROUND OF THE INVENTION

Lower leg injuries are common and can result in lifelong weakness and recurring injuries. Rehabilitation techniques and the use of physical therapy are important methods to improve strength, range of motion, proprioception and flexibility of injured areas, or they may be used as techniques for prevention of injuries. Without proper rehabilitation, serious problems may result, such as chronic pain, swelling, weakness, or even more severe injuries such as the onset of stress fractures.

Physical therapy involves the combined use of mechanical force and movements, manual therapy, and exercise therapy to promote the mobility and function of various areas of the body. Such work is generally performed under the supervision and direction of physical therapists. Physical therapists are trained in many area of rehabilitation, including the rehabilitation of the lower leg.

Injuries to the lower leg may occur due to various circumstances. These may include sports injuries, impacts, repetitive motion, automobile collisions, and genetic susceptibility. Physical therapists use a patient's specific history and physical examination to establish a specialized management plan that works for the individual. Sometimes, this plan includes the use of resistance training to strengthen the injured area. During resistance training, the patient is asked to move an extremity against a resistive force provided by the physical therapist. Resistance can be administered via directly applied force, via free weights, or through other methods such as by elastic bands.

The use of elastic resistance bands is common in physical therapy due to the ease of use and relative low cost of the equipment. In this type of therapy, one end of an elastic band is generally looped around the extremity to be treated and the other end of the band is anchored. The patient pulls on the elastic band to create a resistive force. Patients are then instructed to complete a repetition or a pattern of movements generally in opposition to the resistance created by the elastic bands. This resistance is usually enabled by a second person who anchors the otherwise free end of the band. Different exercises, including different directions of resistance, are used so as to provide a complete manipulation of the extremity and engage all muscles, tendons, and/or ligaments that are being targeted.

In particular with regard to ankle and foot injuries, it is common to use rehabilitation exercises whereby the patient sits on the floor or on a table with the injured leg extended, the heel pointing down and the toes pointing upward. One end of a resistance band is then placed around the foot or the toes. While the opposite end of the resistance band is held in position by a second person, the patient is asked to move the foot in one or more directions while the band provides resistance.

One drawback of elastic band resistance training is that the second person, who anchors the elastic band, is usually required to remain substantially static and at a known distance and angle with respect to the patient. The purpose of this is to create a consistent level of resistance is provided. Even slight variations in positioning, during a session or between sessions, can affect the efficacy of the training.

Another drawback is that in some instances it is desirable to use multiple elastic bands, having different resistances, and at different angles relative to the patient. At present this normally requires multiple persons to anchor the elastic band.

Therefore, there is a need in the prior art to provide a device and method for applying single and multi-directional resistance to an extremity of the body. There is a further need in the art to provide an elastic band resistance physical therapy device that may be used by a patient alone, without the need of a second person anchoring the elastic band or bands.

SUMMARY OF THE INVENTION

The following summary is provided to introduce a selection of concepts in a simplified form that are further described in the detailed description. This summary is not intended to identify key features or essential feature of the claimed subject matter, nor is it intended to be used to limit the scope of the claimed subject matter.

The present disclosure is directed to an apparatus and method for providing multidirectional elastic band resistance to an extremity of the body.

According to one implementation of the invention, provided is an anchoring member comprised of a peripheral frame defining an open space, along with one or more mount points disposed on the peripheral frame. The anchoring member is supported above the floor by one or more vertical support members that rest on a floor base. The vertical support members may be adjustable in height and comprise a telescoping assembly. The anchoring member is supported so that the open space of the peripheral frame is exposed and accessible to the extremity being treated. In the case of treatment of the foot, the peripheral frame is accessible from the direction of the floor.

A patient is directed to introduce his or her lower leg from directly below the anchoring member. The heel of the patient is placed directly below the anchoring member, resting on the floor or on an optional support, with the foot extending into the open space of the peripheral frame of the anchoring member. An elastic band is provided, and attached at one of its ends, to one of the mount points of the peripheral frame of the anchoring member. The other end of the elastic band is engaged with the foot of the patient, creating resistance on the foot. By using multiple bands and various mount points, resistance may be applied from several directions simultaneously. The patient may then move his or her foot in accordance with a physical therapy routine, engaging the muscles and tendons of multiple areas of the foot due to the multidirectional resistance. Certain combinations of elastic band placements, and elastic bands providing differing resistance, may be used to target specific muscle groups of the foot or ankle to increase strength, flexibility, range of motion, and proprioception of a targeted area.

According to another implementation of the invention, the device comprises a base member, a top member, and an anchoring member, all of which have a generally horizontal orientation. The base member is generally comprised of an upward facing surface and a downward facing surface. A support platform is coupled to the upward facing surface of the base member. The support platform may be resilient or cushioned and may incorporate a removable uneven surface. The anchoring member is comprised of a peripheral frame defining an open space, along with one or more mount points disposed on the peripheral frame. The base member and the top member may be mechanically coupled by one or more vertical support members, providing for a space between the base member and top member. In one embodiment of the device, the vertical support members may be adjustable in height and may optionally comprise a telescoping assembly.

The anchoring member is situated between the base member and top member, being mechanically coupled to one or more of the vertical support members, or to the top or base members, via one or more support struts. A patient is directed to introduce his or her lower leg through a side opening between the top and base members, directly below the anchoring member. The heel of the patient is placed centrally on the support platform of the base member, with the foot extending into open space of the anchoring member. An elastic band is provided, and attached at one of its ends, to one of the mount points of the peripheral frame of the anchoring member. The other end of the elastic band is engaged with the foot of the patient, creating resistance on the foot. By using multiple bands and various mount points, resistance may be applied from several directions simultaneously. The patient may then move his or her foot in accordance with a physical therapy routine as described above.

Although the invention is illustrated and described herein as embodied in a multidirectional resistance device and method, it is nevertheless not intended to be limited to only the details shown, since various modifications and structural changes may be made therein without departing from the spirit of the invention and within the scope and range of equivalents of the claims.

These and other objects, features, and advantages of the present invention may be more clearly understood and appreciated from a review of ensuing detailed description of the preferred and alternate embodiments and by reference to the accompanying drawings and claims.

DETAILED DESCRIPTION OF THE EMBODIMENTS OF THE INVENTION

While the present invention will be described more fully hereinafter with reference to the accompanying drawings, in which an embodiment of the present invention is shown, it is to be understood at the outset of the description which follows that persons of skill in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
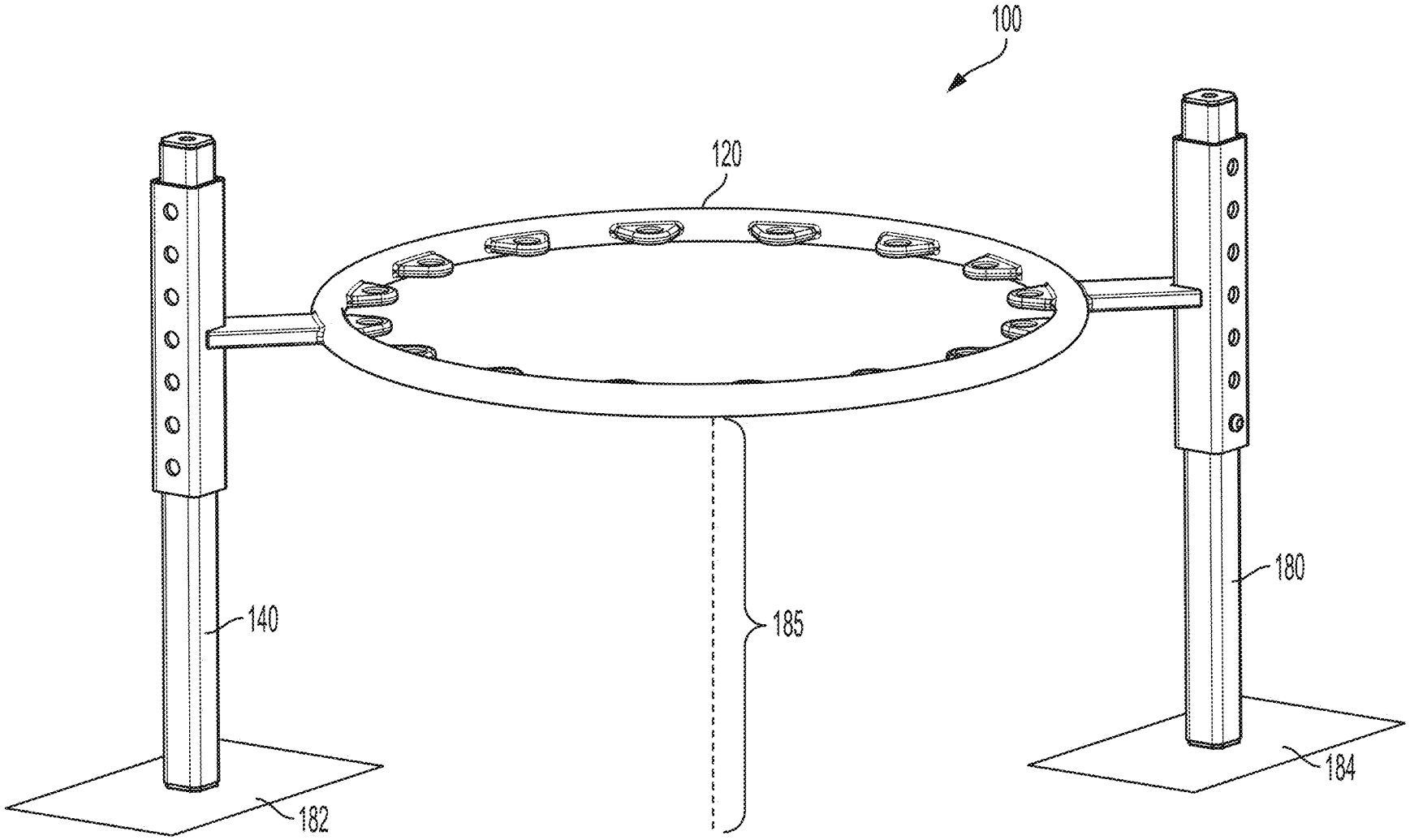
FIG. 1 shows a front perspective view of the device according to one embodiment of the disclosure.

Referring initially to FIG. 1, an example implementation of an elastic band resistance device 100 is shown comprising a anchoring member 120 and one or more vertical support members 140, 180. The anchoring member 120 may have a generally horizontal orientation. The one or more vertical support members 140, 180 may have a generally vertical orientation and extend below the anchoring member 120. However, the one or more vertical support members 140, 180 need not be completely vertical and may be slanted, curved, or any other configuration known to those having ordinary skill in the relevant art. The one or more vertical support members 140, 180 may terminate in one or more base supports 182, 184 to provide stability to device 100.

Although the embodiment shown in FIG. 1 comprises two vertical support members, embodiments including as few as one vertical support members are envisioned but not shown.

As shown on FIG. 1, the anchoring member 120 may be mechanically coupled to the one or more vertical support member 140. The vertical support members 140, 180 provide a clearance area 185 between the anchoring member 120 and the surface upon which the elastic band resistance device 100 rests. The length of the vertical support members 140 may be adjustable, thereby giving the elastic band resistance device 100 the capability to increase or decrease the size of the clearance area 185 between the anchoring member 120 and the surface upon which the elastic band resistance device 100 rests. The length of the vertical support members 140 may be adjusted via a telescoping design, wherein the vertical support members 140 may comprise of at least two support components.

Figure 2A:
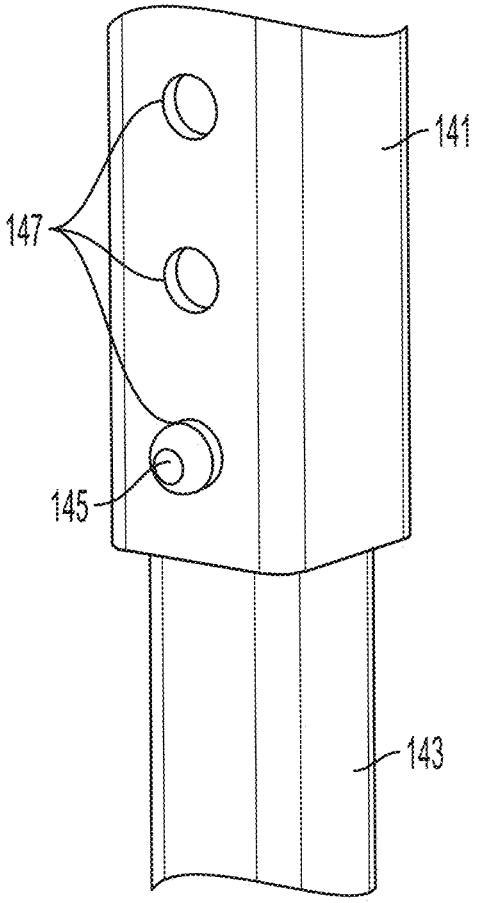
FIG. 2A shows a view of a telescoping vertical support according to one embodiment of the disclosure.
Figure 2B:
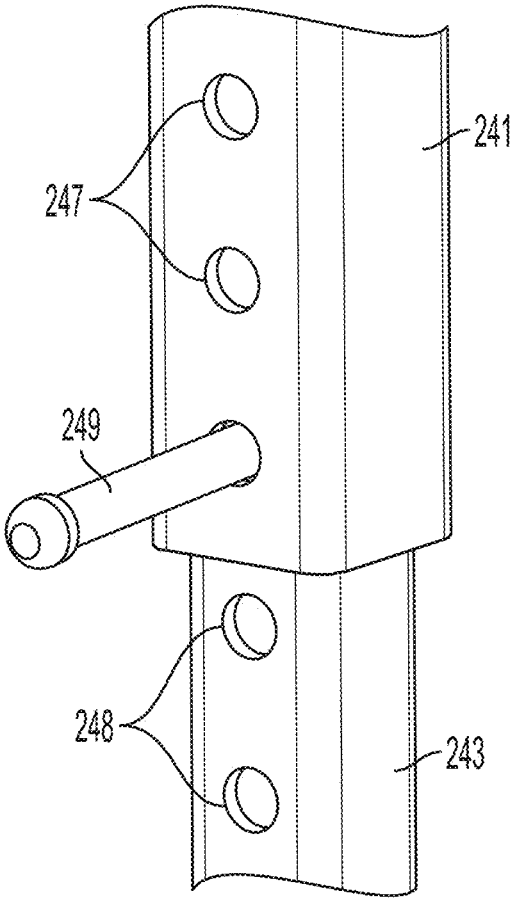
FIG. 2B shows a view of a telescoping vertical support according to a second embodiment of the disclosure.

In one embodiment, as shown in FIGS. 2A and 2B, the vertical support member 140 comprises an upper support component 141 and a lower support component 143. The upper support component 141 and the lower support component 143 may be concentric to one another with the lower support component 143 being partially housed within the upper support component 141.

Referring to FIG. 2A, in one embodiment of the invention the lower support component 143 may comprise a locking button 145, extending outward from the lower support component 143. The locking button 145 may function as a spring, whereas it may be partially recessed upon exertion of force and then return outwardly to its resting state upon release of the force. The upper support component 141 may comprise of one or more outer locking holes 147, whereby the locking button 145 of the lower support component 143 may be secured in the outer locking hole 147, thereby securing the upper support component 141 to the lower support component 143.

Referring to FIG. 2B, a second embodiment of the telescoping assembly of the vertical support members 140 also comprises a concentric upper support component 241 and lower support component 243. The lower support component 243 may have one or more inner locking holes 248 along its length of substantially similar size to the outer locking holes 247 of the upper support component 241. Upon alignment of an inner locking hole 248 and an outer locking hole 247, a locking pin 249 may be inserted through the outer locking hole 247 and inner locking hole 248, thereby securing the upper support component 241 to the lower support component 243. The telescoping assembly of the vertical support members 140 may involve multiple concentric components and should not be seen as limited to solely two components. Further, the concentric components of the vertical support members 140 may be of various shapes, such as cylindrical or prismatic.

Figure 3:
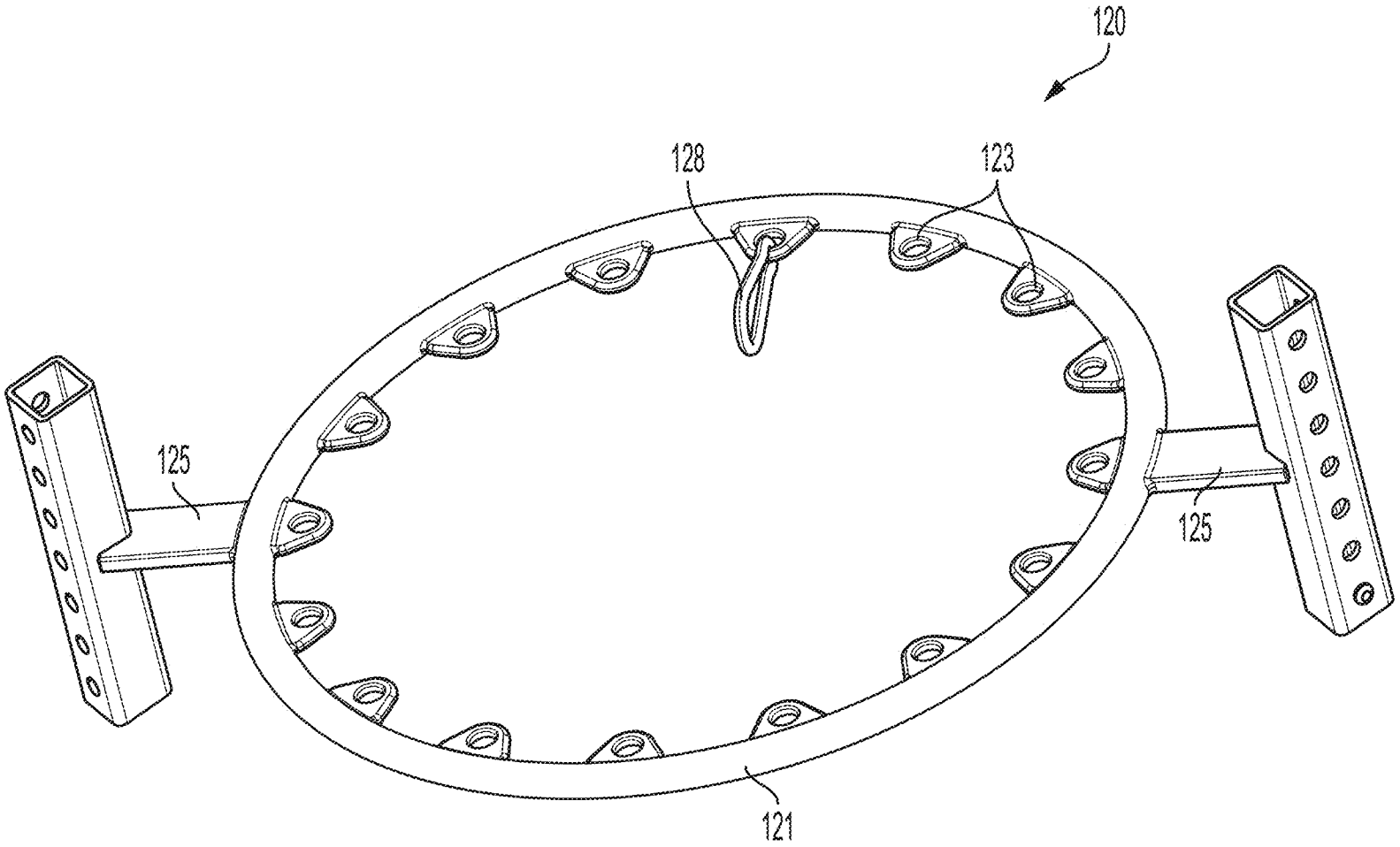
FIG. 3 shows a perspective view of the anchoring member according to one embodiment of the disclosure.

Referring to FIG. 3, the anchoring member 120 is shown, comprising a peripheral frame 121. The peripheral frame 121 defines an open space centrally located inside the anchoring member 120. Further, disposed upon the peripheral frame 121 of the anchoring member 120 are one or more mount points 123. The anchoring member 120 may be further comprised of one or more struts 125, extending outwardly from the peripheral frame 121.

Figure 4A:
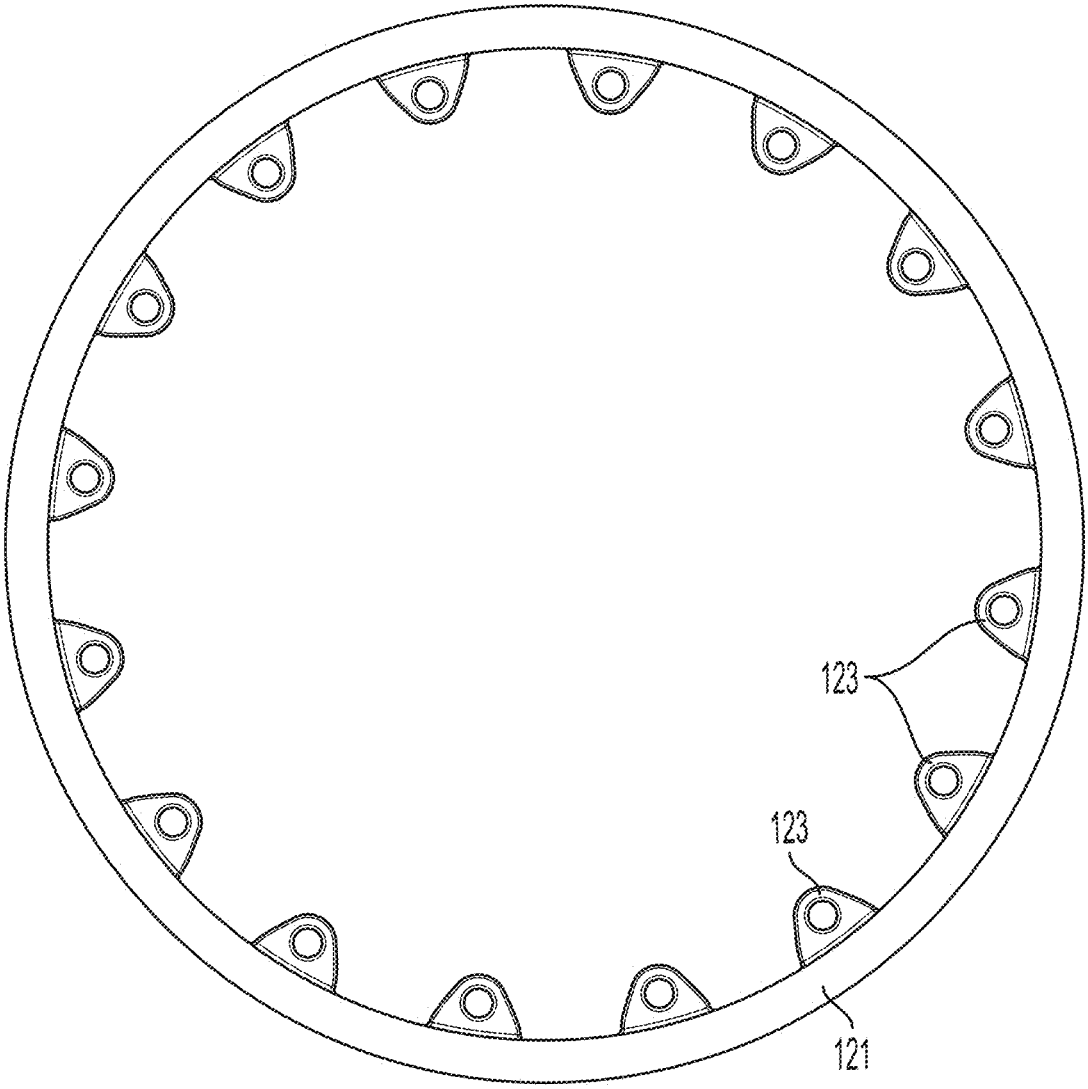
FIG. 4A shows a top view of the peripheral frame of the anchoring member according to one embodiment of the disclosure.

As shown in FIG. 4A, a plurality of mount points 123 may be evenly spaced along the peripheral frame 121. In one embodiment of the invention, the mount points 123 are tabs projected into the open space. Each mount point 123 may feature a hole upon which a clip 128 may be fastened. An elastic band may then be properly attached to the clip 128 for use with the device 100. Alternatively, the elastic band may be directly fastened upon the mount point 123, without the use of the clip 128.

Figure 4B:
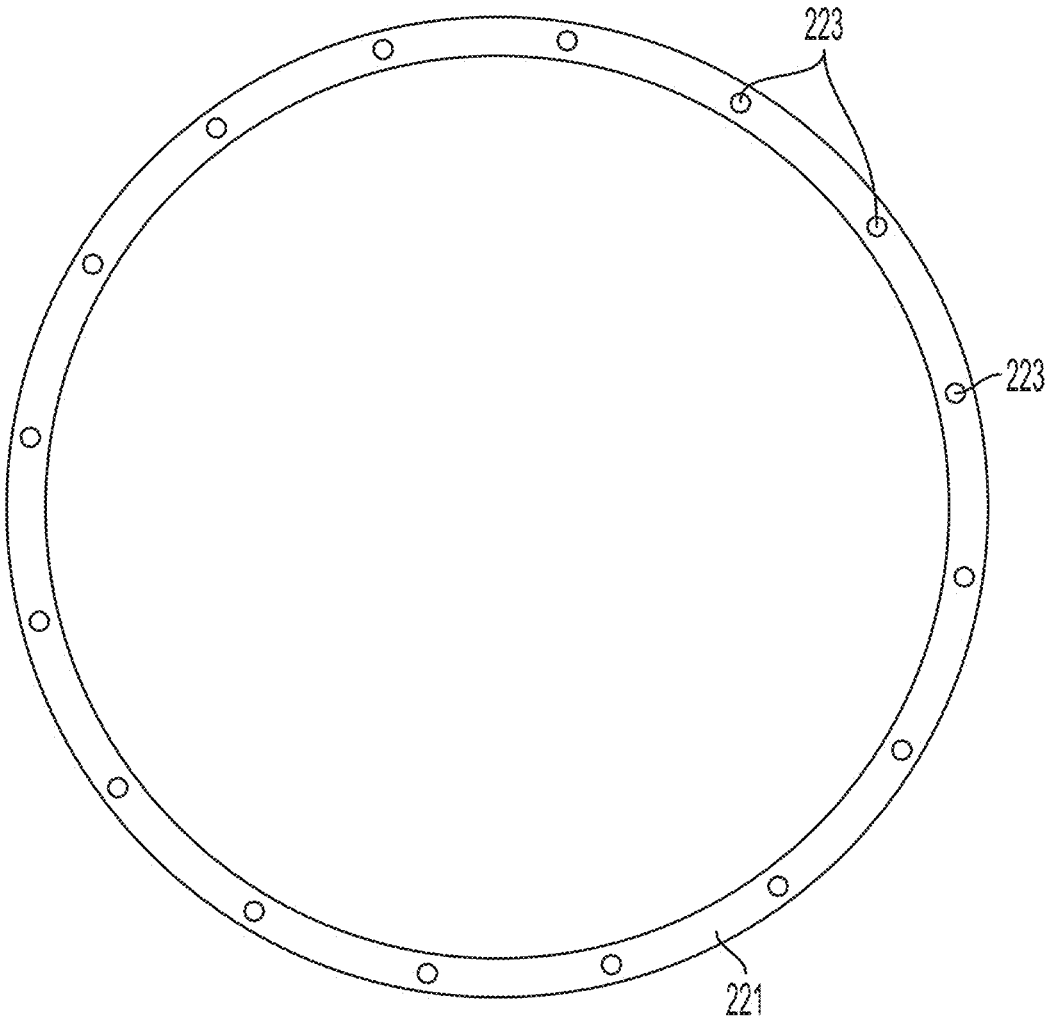
FIG. 4B shows a top view of the peripheral frame of the anchoring member according to another embodiment of the disclosure.

Referring to FIG. 4B, another embodiment of the peripheral frame 221 is shown. In this embodiment, the plurality of mount points 223 are disposed through the peripheral frame 221 of the anchoring member 120. The mount points 223 may be holes or recesses through the peripheral frame 221, whereby the clip 128 may be attached. An elastic band may then be attached to the clip 128 for use of the device 100. Alternatively, the elastic band may be directly fastened upon the mount point 223, without the use of the clip 128. However, in other embodiments of the invention the mount points 123 may be configured as upward or downward projections, hooks, clasps, or other methods known in the art.

The struts 125 of the anchoring member 120 allow for the anchoring member 120 to be secured to one or more of the vertical support members 140. In one embodiment, the strut 125 of the anchoring member 120 may be a sleeve configuration that slides around one or more of the vertical support members 140. The strut 125 may then be locked into place on the vertical support member 140 by any method of attachment known in the art. In one embodiment of the invention, the strut 125 is secured by a lock button placed on the vertical support member 140 that engages with a locking hole on the strut 125, similar to the locking configuration of FIG. 2A. In another embodiment of the invention, the strut 125 is secured to the vertical support member 140 by a locking pin being threaded through a locking hole of the strut 125 and a second locking hole of the vertical support member 140, similar to the locking configuration of FIG. 2B. However, the strut 125 may be secured to the vertical support member 140 by other methods, such as interference fits, nut and bolt fasteners, adhesives, rivets, threaded screws and other methods known in the art. Alternatively, the strut 125 need not be a separate component of one or more of the vertical support members 140, and the strut 125 and the vertical support member 140 may be manufactured as an integral piece.

Figure 5:
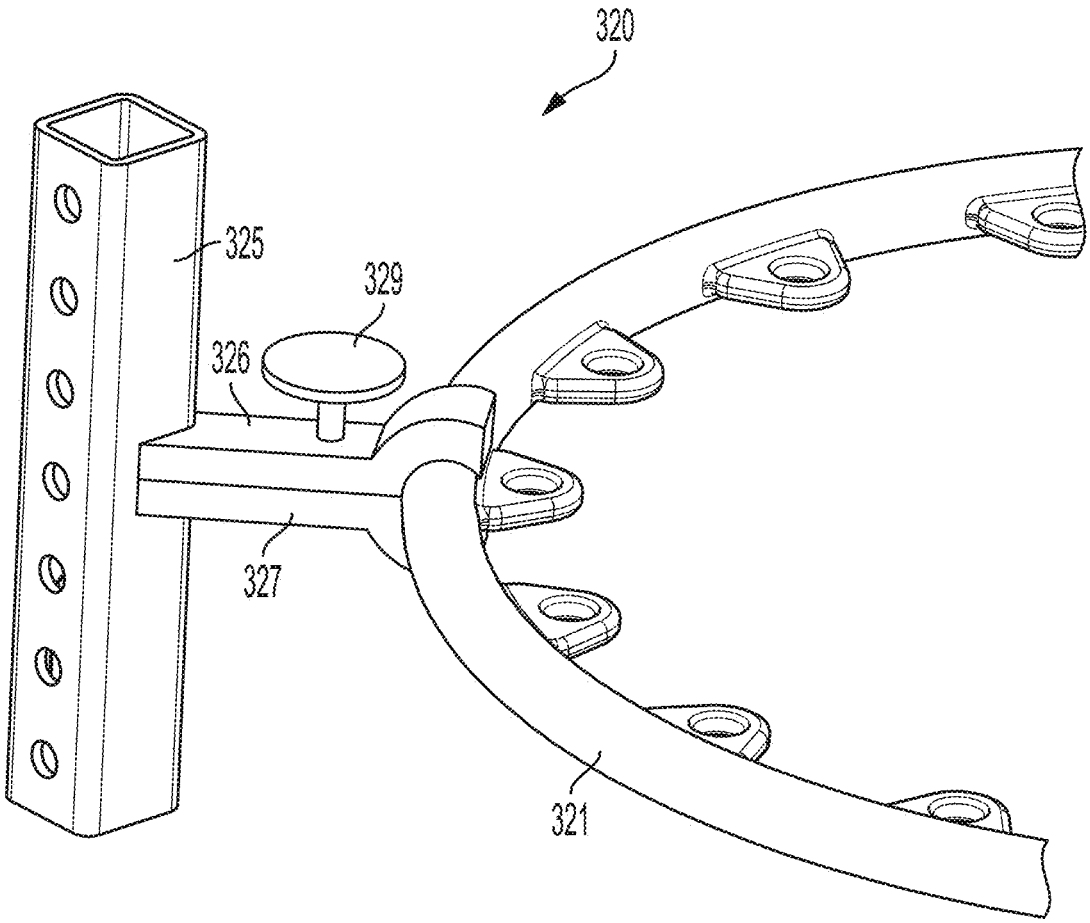
FIG. 5 shows a coupling mechanism linking the peripheral frame of the anchoring member to a support strut of the anchoring member according to one embodiment of the disclosure.

Referring to FIG. 5, another embodiment of the anchoring member 320 is shown. The peripheral frame 321 of the anchoring member 320 may have the ability to rotate relative to one or more of the struts 325. Such rotation may be possible by manufacturing the strut 125 and the peripheral frame 321 as separate components, which may then be coupled via various methods. In one embodiment, the strut 325 may compose of an upper strut component 326 and lower strut component 327. The upper strut component 326 and the lower strut component 327 may each have a receiving end that has the ability to receive the peripheral frame 321. The strut 325 may further comprise a tightening screw 329 that is threaded through the upper strut component 326 and into the lower strut component 327. Upon rotation of the tightening screw 329, the upper strut component 326 may be compressed downward upon the lower strut component 327. The compression of the upper strut component 326 upon the lower strut component 327 will supply pressure upon the peripheral frame 321 at the receiving ends of the upper strut component 326 and lower strut component 327, thus locking the rotational orientation of peripheral frame 321. However, the peripheral frame 321 may be secured to one or more of the struts 325 to allow for rotational adjustment via other known methods in the art.

In one embodiment of the elastic band resistance device 400, the device may comprise a base member 430 situated below the anchoring member 420 and coupled to a bottom end of one or more of the vertical support members 440. The base member 430 may be comprised of an upward facing surface and a downward facing surface. The base member 430 may be used to stabilize the device 400 and provide more support to one or more of the vertical support member 440.

Figure 6:
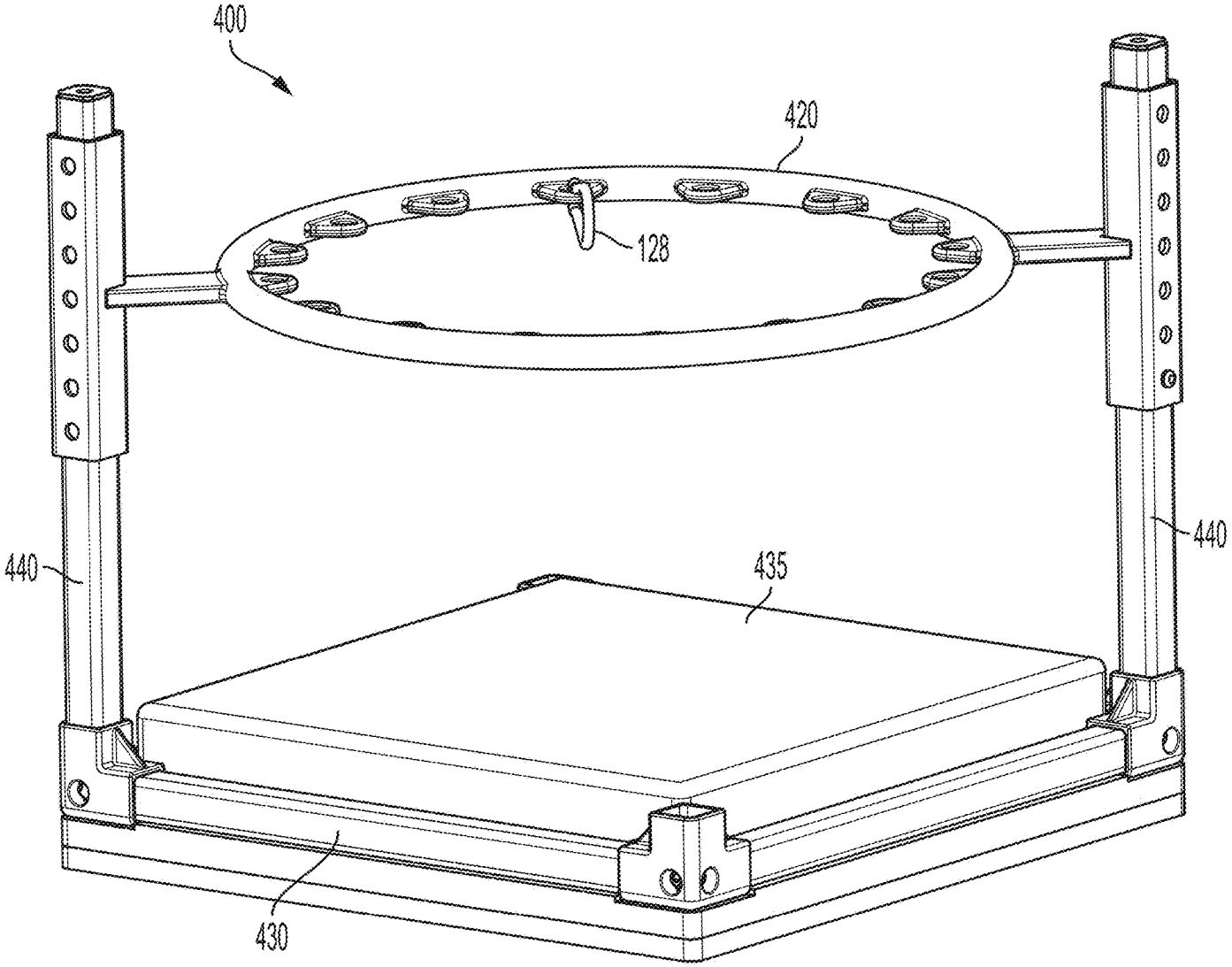
FIG. 6 shows a front perspective view of the device according to a second embodiment of the disclosure.
Figure 7:
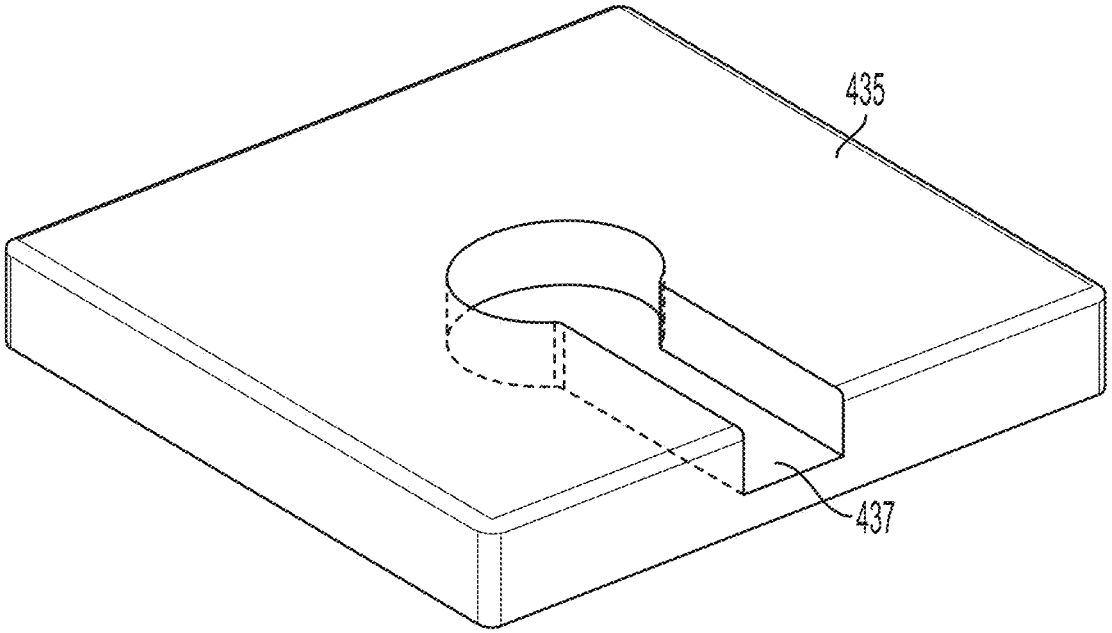
FIG. 7 shows a front perspective view of a support platform of a base member of the device according to one embodiment of the disclosure.

As shown in FIG. 6, the base member 430 may further comprise a support platform 435 mechanically coupled to the upward facing surface of the base member 430. The support platform 435 may be used as a location for a user to rest a heel of their foot when engaged with the device 400. The support platform 435 may be made of a resilient cushioned material, as to provide comfort to the heel of the user when the device 400 is engaged. The support platform 435 may also incorporate a removable (e.g. attached using hook-and-loop or snap fasteners) or fixed uneven surface for balance exercises. Further, as shown in FIG. 7, the support platform 435 may be comprised of a recessed contour 437, whereupon the lower leg and heel of the user may rest and be more firmly secured to the support platform 435. The recessed contour 437 further stabilizes the lower leg of the user, increasing the effectiveness of training techniques performed with the device 400.

Figure 8:
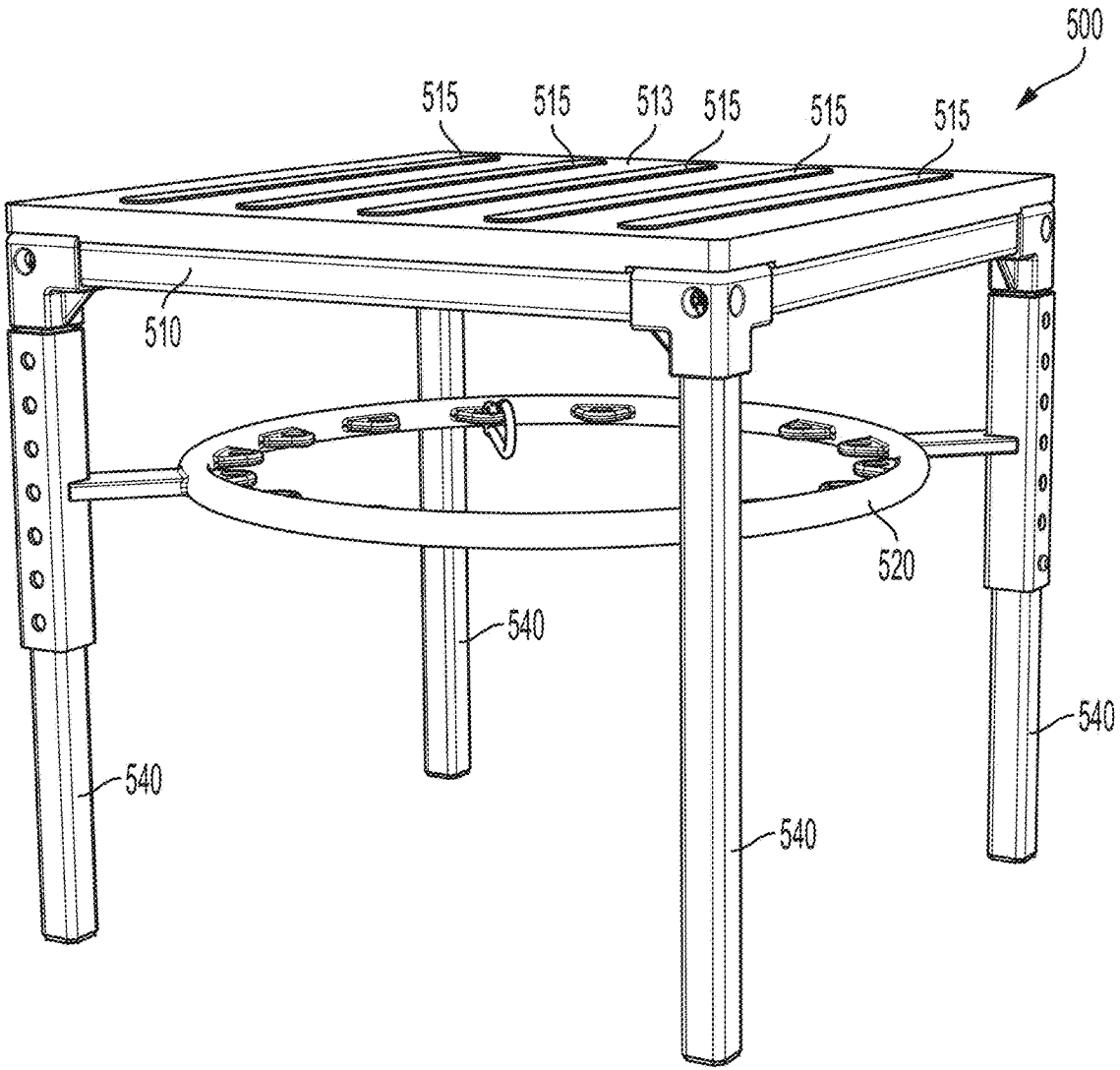
FIG. 8 shows a front perspective view of the device according to a third embodiment of the disclosure.
Figure 12:
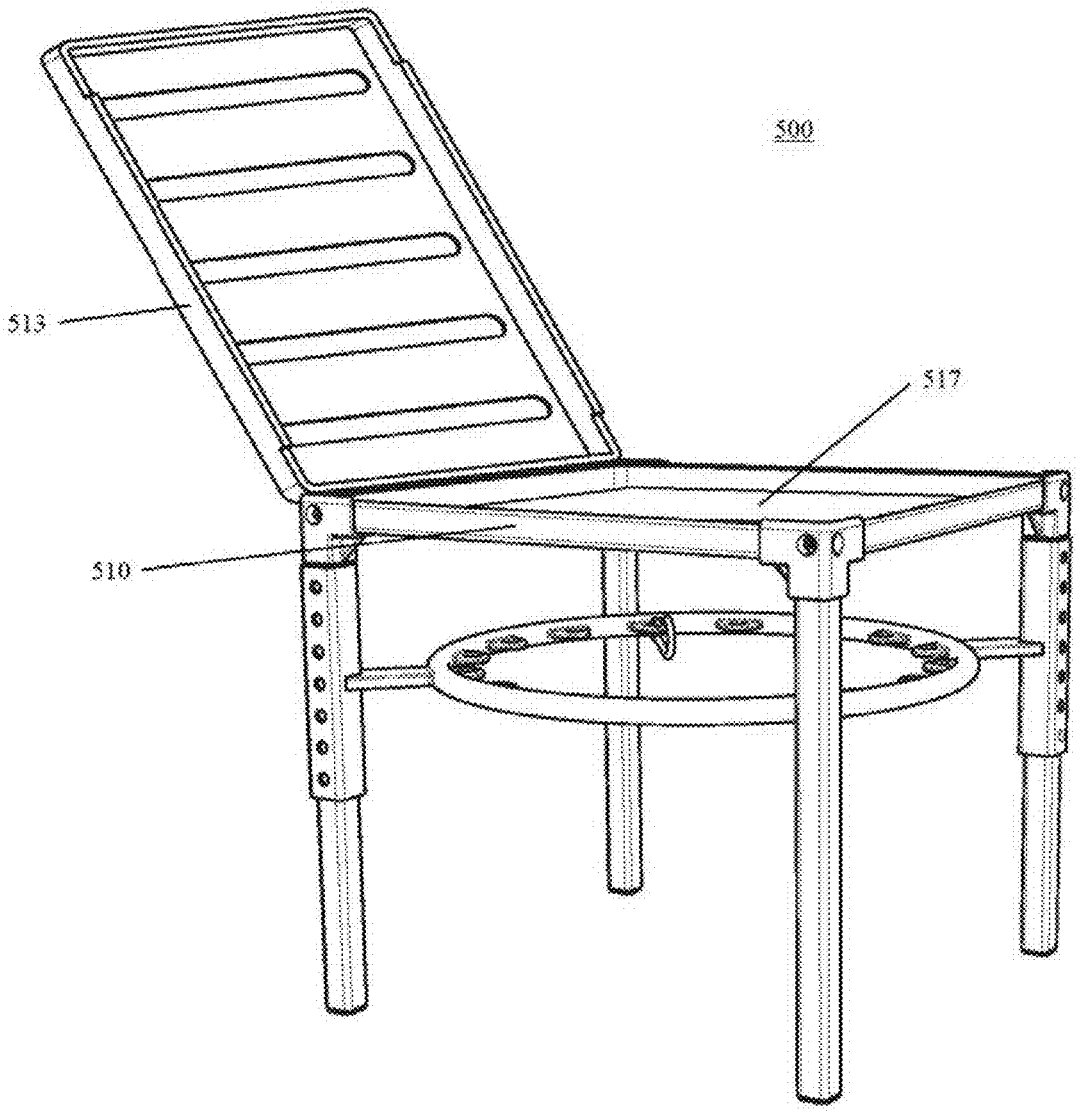
FIG. 12 shows a perspective view of the device with a storage box according to an embodiment of the disclosure.

Referring to FIG. 8, in one embodiment, the elastic band resistance device 500 further may comprise of a top member 510, having a generally horizontal orientation and situated above the anchoring member 520. The top member 510 may be coupled to one or more of the vertical support members 540. The top member 510 may assist in the overall stability of the device 500 by providing further coupling between two or more of the vertical support members 540. The top member 510 may further be comprised of a horizontal platform 513. The horizontal platform 513 may have a generally horizontal orientation and provide a stepping surface for the user to be used in conjunction with training and rehabilitation techniques. The horizontal platform 513 may be made of various materials, such as wood, plastic, or other material known in the art that may support the load of an average user. The horizontal platform 513 may further comprise of friction strips 515, providing for additional friction between the foot of a user and the horizontal platform 513. The use of the friction strips 515 would decrease the likelihood of the foot of a user slipping off the horizontal platform 513 when the device 500 is being engaged. The horizontal platform 513 may be coupled to the top member 510 via various methods, such as nut and bolt fasteners, adhesives, clasps, threaded screws and other methods known in the art. Further, the horizontal platform 513 may be manufactured as an integral piece of the top member 510. The horizontal platform 513 may further be configured to comprise a storage box 517, as shown in FIG. 12. The storage box 517 of the horizontal platform 513 may be used to store elastic bands, extra clips, or other various training material.

Figure 9:
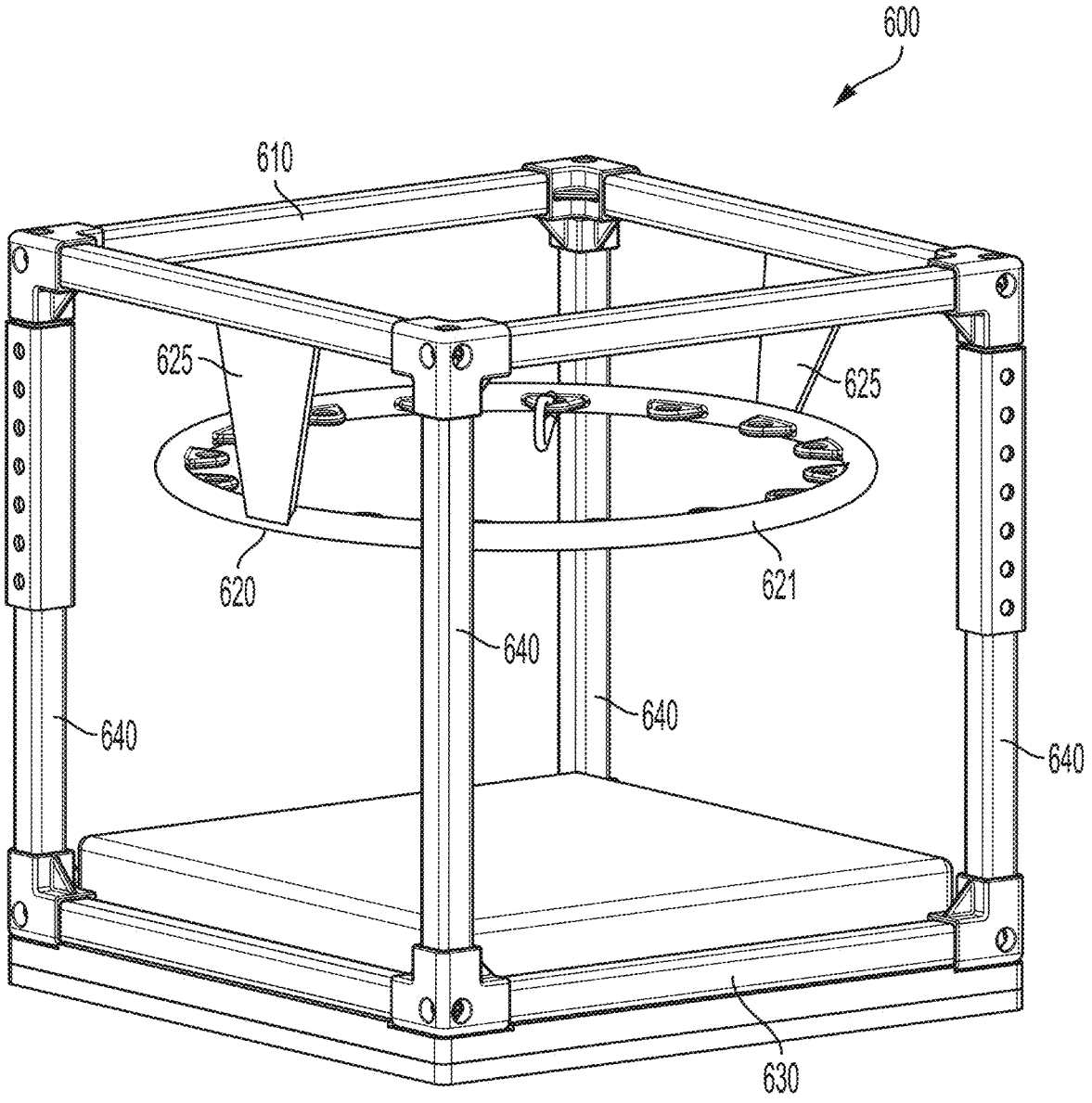
FIG. 9 shows a front perspective view of the device according to an fourth embodiment of the disclosure.

As shown in FIG. 9, in one embodiment of the device 600, the top member 610 may be mechanically coupled directly to the base member 630 by one or more of the vertical support members 640. Further, one or more of the struts 625 of the anchoring member 620 may extend upwardly from the peripheral frame 621 and be mechanically coupled to one or more of the vertical support member 640 via a connection to the top member 610.

The top member 610 and the base member 630 may be substantially square in shape; however, the top member 610 and base member 630 are not limited to any particular shape, and they may be square, rectangular, circular, octagonal, trapezoidal, hexagonal or oval, among other shapes. The anchoring member 620 may be substantially circular in shape; however, the anchoring member 620 is not limited to any particular shape, and it may be square, rectangular, circular, octagonal, trapezoidal, hexagonal or oval, among other shapes.

Figure 10:
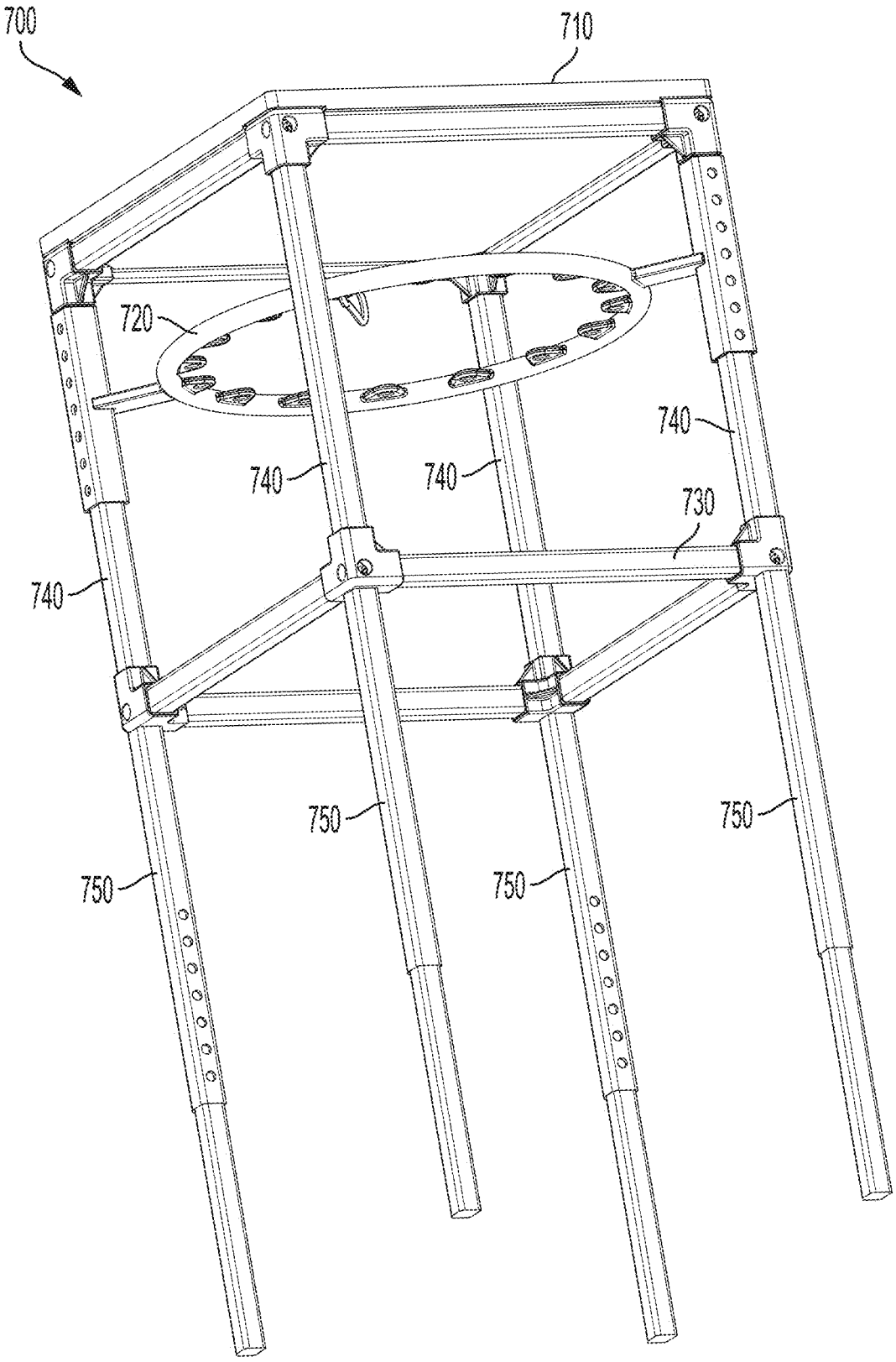
FIG. 10 shows a perspective view of the device detailing support legs of the base member according to another embodiment of the disclosure.

Referring to FIG. 10, in one embodiment of the device 700, vertical support members 740 may support anchoring member 720 and may terminate in a base member 730 that may, in turn, comprise three or more support legs 750 mechanically coupled to the downward facing surface of the base member 730. The support legs 750 may allow for additional height adjustment of the device 700. The support legs 750 may comprise of a telescoping design, allowing for incremental adjustment of the device height. The telescoping design may be comprised of a locking button mechanism, similar to that detailed in FIG. 2A. Alternatively, the telescoping design may comprise a locking pin mechanism, similar to that detailed in FIG. 2B. However, the support legs 750 may be adjustable by various methods known by those of ordinary skill in the art. As in previously described embodiments, the device 700 may further comprise a horizontal platform 710 that may have a generally horizontal orientation and provide a stepping surface for the user to be used in conjunction with training and rehabilitation techniques.

Figure 11:
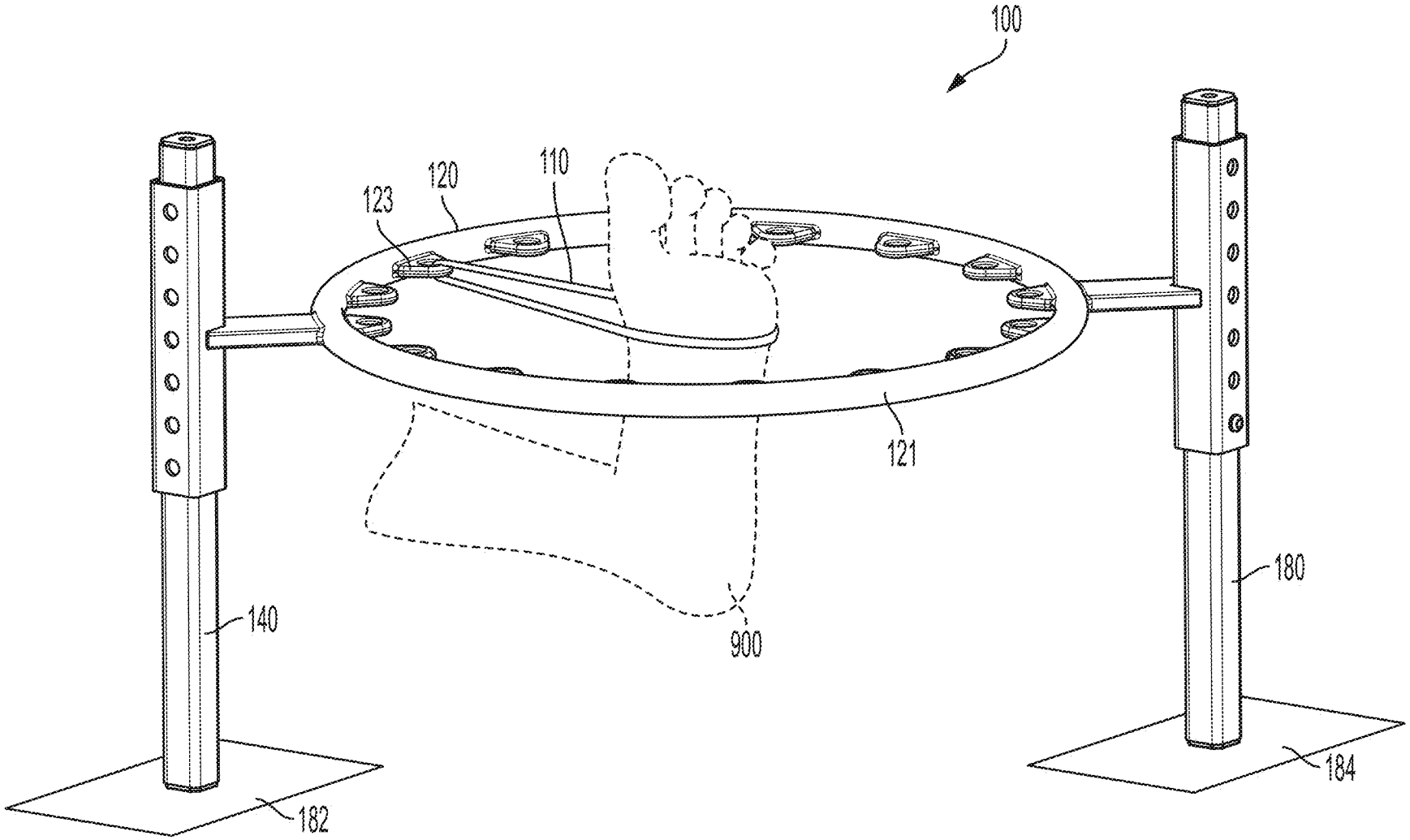
FIG. 11 shows a perspective view of the device engaged by a user according to an embodiment of the disclosure.

An example of the method of use of the device, with reference to the embodiment described in FIG. 1, is shown in FIG. 11. A user may utilize the device 100 by first arranging the device in a position where the clearance area 185 of the device is at a height equal with a horizontally outstretched leg of the user. The user is to then insert a foot 900 through a side opening opposite of a sole vertical support member 140, or between two or more of the vertical support members 140, 180 directly below the anchoring member 120. The heel of the foot 900 may rest centrally below the peripheral frame 121 of the anchoring member 120, and the tip of the foot 900 may extend upwardly into the open space defined by the peripheral frame 121.

An elastic band 110 may then be secured to a clip 128 (not shown) that is attached to a mount point 123, or the elastic band 110 may be directly secured to the mount point 123. After securement of the elastic band 110 to a mount point 123 of the anchoring member 120, the elastic band 110 is wrapped around the foot 900 of the user, which is extended upwardly in the open space defined by the peripheral frame 121. An additional elastic band 110 (not shown) may be secured to a second clip 128 or a second mount point 123, and then also wrapped around the foot 900 of the user. The use of the additional elastic band 110 allows for multidirectional resistance to be applied to the foot 900 of the user. Additional elastic bands 110 and mount points 123 may be used to provide additional directions of resistance. The user may then perform basic maneuvers with their foot 900 inside the open space, activating and training different muscle groups and tendons of the lower leg. By providing for multiple directions of resistance, various targeted muscles and tendons of the lower leg may be engaged simultaneously, leading to a quicker and more complete training session. The elastic bands 110 may be comprised of various elasticities, leading to varying levels of resistance in each band. Different resistance levels of elastic bands 110 may be used with the device 100 simultaneously to create increased resistance from one or more directions.

Accordingly, it will be understood that several embodiments of the present invention have been disclosed by way of examples and that other modifications and alterations may occur to those skilled in the art without departing from the scope and spirit of the appended claims.

I claim:

1. A physical therapy and rehabilitation device for strengthening and exercising a lower leg of a user, the device comprising:

an anchoring member and one or more vertical support members;

the anchoring member having a substantially horizontal orientation and comprising a peripheral frame defining an open space, the anchoring member further comprising one or more mount points disposed on said peripheral frame;

the anchoring member coupled by the one or more vertical support members;

one or more elastic bands, each of the one or more elastic bands coupled to at least one of the one or more mount points of the anchoring member and further configured to engage a distal end of a foot of the lower leg of the user inside the open space;

a top member having a substantially horizontal orientation, the top member coupled to the one or more vertical support members and positioned above the anchoring member;

the top member comprising a storage box and a step surface;

an opening adapted to provide access for a user of the device to position the foot and the lower leg of the user below the anchoring member; and the opening further adapted to permit the user to dispose the foot of the lower leg of the user inside the open space of the peripheral frame of the anchoring member, and to engage the distal end of the foot of the lower leg of the user to the one or more elastic bands, while a heel of the foot of the lower leg of the user rests below the anchoring member.

2. The training and rehabilitation device of claim 1, wherein at least one of the one or more vertical support members is adjustable in length.

3. The training and rehabilitation of claim 2, wherein at least one of the one or more vertical support members comprises a telescoping assembly.

4. The training and rehabilitation device of claim 1 further comprising a base member having a generally horizontal orientation coupled to one or more of the vertical support members, the base member positioned below the anchoring member, the base member comprising an upward facing surface and downward facing surface.

5. The training and rehabilitation device of claim 4 further comprising three or more leg members extending downward from the downward facing surface of the base member.

6. The training and rehabilitation device of claim 5 wherein at least one of the three or more leg members is adjustable in length.

7. The training and rehabilitation device of claim 4 further comprising a support platform coupled to the upward facing surface of the base member.

8. The training and rehabilitation device of claim 7 wherein the support platform is adapted to receive the heel of the foot of the lower leg of the user and the lower leg of the user.

9. The training and rehabilitation device of claim 8 wherein the support platform is contoured in the shape of the heel of the foot of the lower leg of the user and the lower leg of the user.

10. The training and rehabilitation device of claim 7 wherein the support platform comprises a resilient cushioning material.

11. The training and rehabilitation device of claim 7 wherein the support platform comprises an uneven surface.

12. The training and rehabilitation device of claim 1 wherein at least one of the one or more struts is adapted to couple to the one or more vertical support members at a plurality of attachment points along the one or more vertical support members, enabling vertical adjustment of the anchoring member.

13. The training and rehabilitation device of claim 1 wherein at least one of the one or more struts is adapted to couple to the anchoring member at a plurality of attachment points along said anchoring member enabling rotational adjustment of the anchoring member.

14. The training and rehabilitation device of claim 1 wherein the peripheral frame of the anchoring member has a generally circular shape.

* * * * *